US008860541B2

(12) United States Patent
Piascik et al.

(10) Patent No.: US 8,860,541 B2
(45) Date of Patent: Oct. 14, 2014

(54) ELECTROMAGNETIC COIL ASSEMBLIES HAVING BRAIDED LEAD WIRES AND METHODS FOR THE MANUFACTURE THEREOF

(75) Inventors: James Piascik, Randolph, NJ (US); Eric Passman, Piscataway, NJ (US); Robert Franconi, New Hartford, CT (US)

(73) Assignee: Honeywell International Inc., Morristown, NJ (US)

( * ) Notice: Subject to any disclaimer, the term of this patent is extended or adjusted under 35 U.S.C. 154(b) by 491 days.

(21) Appl. No.: 13/276,064

(22) Filed: Oct. 18, 2011

(65) Prior Publication Data

US 2013/0093550 A1 Apr. 18, 2013

(51) Int. Cl.
*H01F 27/02* (2006.01)

(52) U.S. Cl.
USPC ..... 336/96

(58) Field of Classification Search
USPC ..... 336/65, 90, 96, 192
See application file for complete search history.

(56) References Cited

U.S. PATENT DOCUMENTS

| | | | | |
|---|---|---|---|---|
| 1,722,362 | A | 7/1929 | Wiley | |
| 1,742,018 | A | 12/1929 | Wermine | |
| 2,262,802 | A | 11/1941 | Hayden | |
| 2,787,769 | A | 4/1957 | Hill et al. | |
| 2,864,929 | A | 3/1958 | Schwing | |
| 2,848,794 | A | 8/1958 | Roth | |
| 2,879,361 | A | 3/1959 | Haynman | |
| 2,904,619 | A | 9/1959 | Forney, Jr. | |
| 2,944,235 | A | 7/1960 | Peters | |
| 2,997,647 | A | 8/1961 | Gaugler et al. | |
| 3,019,403 | A | 1/1962 | Kamm | |
| 3,223,553 | A | 12/1965 | Morey | |
| 3,256,417 | A | 6/1966 | Merrett | |
| 3,308,411 | A | 3/1967 | Roshala | |
| 3,308,414 | A * | 3/1967 | Ostrander et al. | 336/205 |
| 3,336,553 | A | 8/1967 | Cripps | |
| 3,352,009 | A | 11/1967 | Cohn et al. | |
| 3,373,390 | A | 3/1968 | Rechel | |
| 3,542,276 | A | 11/1970 | James | |
| 3,688,397 | A | 9/1972 | Cleaver et al. | |
| 3,694,785 | A | 9/1972 | Chass | |

(Continued)

FOREIGN PATENT DOCUMENTS

| | | |
|---|---|---|
| CN | 2529429 | 1/2003 |
| CN | 1174814 C | 11/2004 |

(Continued)

OTHER PUBLICATIONS

USPTO Office Action for U.S. Appl. No. 13/460,460 dated Nov. 15, 2013.

(Continued)

*Primary Examiner* — Tuyen Nguyen
(74) *Attorney, Agent, or Firm* — Ingrassia Fisher & Lorenz, P.C.

(57) ABSTRACT

Embodiments of an electromagnetic coil assembly are provided, as are methods for the manufacture of an electromagnetic coil assembly. In one embodiment, the electromagnetic coil assembly includes a body of dielectric material, a coiled magnet wire at least partially embedded within the body of dielectric material, a braided lead wire extending into the body of dielectric material to the coiled magnet wire, and a joint buried within the body of dielectric material and mechanically and electrically coupling the braided lead wire and the coiled magnet wire.

20 Claims, 5 Drawing Sheets

(56) References Cited

U.S. PATENT DOCUMENTS

| | | | |
|---|---|---|---|
| 3,731,368 | A | 5/1973 | Dieteman et al. |
| 3,775,628 | A | 11/1973 | Andersson et al. |
| 3,812,580 | A | 5/1974 | Drugmand |
| 3,862,416 | A | 1/1975 | Phillips et al. |
| 3,881,163 | A | 4/1975 | Lindroth et al. |
| 3,932,928 | A | 1/1976 | King |
| 3,961,151 | A | 6/1976 | Danner |
| 4,056,883 | A | 11/1977 | Danner |
| 4,057,187 | A | 11/1977 | Cranston et al. |
| 4,107,635 | A | 8/1978 | Brundage et al. |
| 4,135,296 | A | 1/1979 | Kami et al. |
| 4,196,510 | A | 4/1980 | Gudmestad et al. |
| 4,258,347 | A | 3/1981 | Konig |
| 4,376,904 | A | 3/1983 | Horrigan |
| 4,388,371 | A | 6/1983 | Bolon et al. |
| 4,429,007 | A | 1/1984 | Bich et al. |
| 4,445,103 | A | 4/1984 | Chass |
| 4,476,192 | A | 10/1984 | Imai et al. |
| 4,524,624 | A | 6/1985 | Di Noia et al. |
| 4,554,730 | A | 11/1985 | Westervelt et al. |
| 4,621,251 | A | 11/1986 | Keefe |
| 4,641,911 | A | 2/1987 | Pavlak et al. |
| 4,786,760 | A | 11/1988 | Friedhelm |
| 4,866,573 | A | 9/1989 | Bernstein |
| 4,870,308 | A | 9/1989 | Sismour, Jr. |
| 4,950,438 | A | 8/1990 | Nakamura et al. |
| 5,091,609 | A | 2/1992 | Sawada et al. |
| 5,105,531 | A | 4/1992 | Sawada et al. |
| 5,122,506 | A | 6/1992 | Wang |
| 5,140,292 | A | 8/1992 | Aronow |
| 5,211,789 | A | 5/1993 | Christian et al. |
| 5,226,220 | A | 7/1993 | Gevas et al. |
| 5,460,503 | A | 10/1995 | Kitajima et al. |
| 5,475,203 | A | 12/1995 | McGaffigan |
| 5,493,159 | A | 2/1996 | Norris |
| 5,497,936 | A | 3/1996 | Vojta et al. |
| 5,636,434 | A | 6/1997 | Okey et al. |
| 5,666,099 | A | 9/1997 | Ostrem |
| 5,675,891 | A | 10/1997 | Childs et al. |
| 5,693,208 | A | 12/1997 | Paulet |
| 5,815,091 | A | 9/1998 | Dames et al. |
| 5,833,825 | A | 11/1998 | Otten et al. |
| 6,009,141 | A | 12/1999 | Hell et al. |
| 6,038,760 | A | 3/2000 | Antoine et al. |
| 6,189,202 | B1 | 2/2001 | Masuda et al. |
| 6,261,437 | B1 | 7/2001 | Hernnaes et al. |
| 6,368,485 | B1 | 4/2002 | Ue et al. |
| 6,750,749 | B2 | 6/2004 | Shirahata et al. |
| 6,847,145 | B2 | 1/2005 | Van Dine et al. |
| 6,909,279 | B2 | 6/2005 | Niwa |
| 6,927,666 | B2 | 8/2005 | Ahn et al. |
| 6,976,308 | B2 | 12/2005 | Jonli |
| 7,129,605 | B2 | 10/2006 | Zhang et al. |
| 7,147,500 | B2 | 12/2006 | Tabata et al. |
| 7,147,929 | B2 | 12/2006 | Amagi et al. |
| 7,365,627 | B2 | 4/2008 | Yen et al. |
| 7,394,022 | B2 | 7/2008 | Gumley |
| 7,459,817 | B2 | 12/2008 | VanLuik et al. |
| 7,513,029 | B2 | 4/2009 | Ortt et al. |
| 7,572,980 | B2 | 8/2009 | Elie et al. |
| 7,588,530 | B2 | 9/2009 | Heilman et al. |
| 7,705,265 | B2 | 4/2010 | Asakura et al. |
| 7,795,538 | B2 | 9/2010 | Kaiser et al. |
| 7,893,583 | B2 | 2/2011 | Du et al. |
| 7,947,905 | B2 * | 5/2011 | Pasini ..... 174/84 R |
| 8,128,441 | B2 | 3/2012 | Mukuno |
| 8,253,299 | B1 | 8/2012 | Rittenhouse |
| 2003/0010813 | A1 | 1/2003 | Nakaya |
| 2003/0020344 | A1 | 1/2003 | Futami et al. |
| 2003/0074884 | A1 | 4/2003 | Snow et al. |
| 2004/0010908 | A1 | 1/2004 | Kobayashi |
| 2004/0140293 | A1 | 7/2004 | Kohama et al. |
| 2004/0158981 | A1 | 8/2004 | Antaya et al. |
| 2005/0012423 | A1 | 1/2005 | Yasuhara et al. |
| 2005/0127774 | A1 | 6/2005 | Sogabe et al. |
| 2007/0279047 | A1 | 12/2007 | Schumacher |
| 2008/0007134 | A1 | 1/2008 | Shimura et al. |
| 2009/0121896 | A1 | 5/2009 | Mitchell et al. |
| 2009/0206974 | A1 | 8/2009 | Meinke |
| 2009/0255319 | A1 | 10/2009 | Sokol |
| 2009/0273254 | A1 | 11/2009 | Heim |
| 2009/0325809 | A1 | 12/2009 | Hong et al. |
| 2010/0018768 | A1 | 1/2010 | Takahashi et al. |
| 2010/0031497 | A1 | 2/2010 | Saka et al. |
| 2010/0176683 | A1 | 7/2010 | Waddell et al. |
| 2010/0189884 | A1 | 7/2010 | Kaiser et al. |
| 2011/0054584 | A1 | 3/2011 | Alexander et al. |
| 2011/0192451 | A1 | 8/2011 | Sato et al. |
| 2012/0126642 | A1 | 5/2012 | Miyamoto et al. |
| 2012/0169174 | A1 | 7/2012 | Radov et al. |
| 2012/0175991 | A1 | 7/2012 | Tassinario et al. |

FOREIGN PATENT DOCUMENTS

| | | | |
|---|---|---|---|
| DE | 3830740 | A1 | 3/1990 |
| DE | 102007034322 | A1 | 1/2009 |
| DE | 102010001888 | A1 | 8/2010 |
| EP | 0012422 | A1 | 6/1980 |
| EP | 0886053 | A2 | 12/1998 |
| FR | 2903246 | A1 | 1/2008 |
| GB | 147786 | | 4/1921 |
| GB | 569196 | | 5/1945 |
| GB | 719126 | A | 11/1954 |
| JP | 2005183554 | A | 7/2005 |
| JP | 2008288512 | A | 11/2008 |
| JP | 2012-105392 | | 5/2012 |

OTHER PUBLICATIONS

USPTO Notice of Allowance for U.S. Appl. No. 13/187,359, dated Apr. 2, 2013.

USPTO Office Action for U.S. Appl. No. 13/038,838, dated Apr. 22, 2013.

Chaklader, et al.; Alumina fibre from aluminium wire, ScienceDirect.com—Composites—Alumina fibre from aluminium wire; retrieved from internet http://www.sciencedirect.com/science/article/pii/0010436181900173.

USPTO Office Action for U.S. Appl. No. 13/187,359, dated Jan. 30, 2013.

R. F. Brazier, "Cables for aircraft. Pressure-type connections." Proceedings of the Institution of Electrical Engineers, Jan. 1, 1967, p. 1307, vol. 114, No. 9.

EPO, European Extended Search Report for Application No. 12175199.4, dated Oct. 17, 2012.

USPTO Notice of Allowance for U.S. Appl. No. 13/038,838 dated Jul. 1, 2013.

USPTO Notice of Allowance for U.S. Appl. No. 13/460,460 dated Feb. 11, 2014.

* cited by examiner

ELECTROMAGNETIC COIL ASSEMBLIES HAVING BRAIDED LEAD WIRES AND METHODS FOR THE MANUFACTURE THEREOF

TECHNICAL FIELD

The present invention relates generally to coiled-wire devices and, more particularly, to electromagnetic coil assemblies including braided lead wires, as well as to methods for the manufacture of such electromagnetic coil assemblies.

BACKGROUND

Magnetic sensors (e.g., linear and variable differential transducers), motors, and actuators (e.g., solenoids) include one or more electromagnetic coils, which are commonly produced utilizing a fine gauge magnet wire; e.g., a magnet wire having a gauge from about 30 to 38 American Wire Gauge. In certain cases, the electromagnetic coils are embedded within a body of dielectric material (e.g., a potting compound) to provide position holding and electrical insulation between neighboring turns of the coils and thereby improve the overall durability and reliability of the coiled-wire device. The opposing ends of a magnet wire may project through the dielectric body to enable electrical connection between an external circuit and the electromagnetic coil embedded within the dielectric body. In many conventional, low temperature applications, the electromagnetic coil is embedded within an organic dielectric material, such as a relatively soft rubber or silicone, that has a certain amount of flexibility, elasticity, or compressibility. As a result, a limited amount of movement of the magnet wire at point at which the wire enters or exits the dielectric body is permitted, which reduces the mechanical stress applied to the magnet wire during assembly of the coiled-wire device. However, in instances wherein the electromagnetic coil is potted within a material or medium that is highly rigid, such as a hard plastic and certain inorganic materials, the magnet wire is effectively fixed or anchored in place at the wire's entry point into or exit point from the dielectric body. As the external segment of the magnet wire is subjected to unavoidable bending, pulling, and twisting forces during assembly, significant mechanical stress concentrations may occur at the wire's entry or exit point from the dielectric body. The fine gauge magnet wire may consequently mechanically fatigue and work harden at this interface during the assembly process. Work hardening of the fine gauge magnet wire may result in breakage of the wire during assembly or the creation of a high resistance "hot spot" within the wire accelerating open circuit failure of the coiled wire device. Such issues are especially problematic when the coiled magnet wire is fabricated from a metal prone to work hardening and mechanical fatigue, such as aluminum.

It would thus be desirable to provide embodiments of an electromagnetic coil assembly including a fine gauge coiled magnet wire, which is at least partly embedded within a body of dielectric material and which is effectively isolated from mechanical stress during manufacture of the coil assembly. Ideally, embodiments of such an electromagnetic coil assembly would provide redundancy in the electrical coupling to the potted coil (or coils) to improve the overall durability and reliability of the electromagnetic coil assembly. It would still further be desirable to provide embodiments of such an electromagnetic coil assembly capable of providing continuous, reliable operation in high temperature applications (e.g., applications characterized by temperatures exceeding 260° C.), such as high temperature avionic applications. Finally, it would be desirable to provide embodiments of a method for manufacturing such an electromagnetic coil assembly. Other desirable features and characteristics of the present invention will become apparent from the subsequent Detailed Description and the appended Claims, taken in conjunction with the accompanying Drawings and the foregoing Background.

BRIEF SUMMARY

Embodiments of an electromagnetic coil assembly are provided. In one embodiment, the electromagnetic coil assembly includes a body of dielectric material, a coiled magnet wire at least partially embedded within the body of dielectric material, a braided lead wire extending into the body of dielectric material to the coiled magnet wire, and a joint buried within the body of dielectric material and mechanically and electrically coupling the braided lead wire and the coiled magnet wire.

Embodiments of a method for manufacturing an electromagnetic coil assembly are further provided. In one embodiment, the method includes the steps of winding a magnet wire around a support structure to produce an electromagnetic coil, creating a joint between the magnet wire and a braided lead wire, and forming a body of dielectric material around the electromagnetic coil in which the joint is at least partially embedded.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the invention or the application and uses of the invention. Furthermore, there is no intention to be bound by any theory presented in the preceding Background or the following Detailed Description.

The following describes embodiments of electromagnetic coil assemblies including electromagnetic coils at least partially embedded, and preferably wholly encapsulated within, an electrically-insulative medium (referred to herein as a "body of a dielectric material" or, more simply, a "dielectric body"). As described in the foregoing section entitled "BACKGROUND," the electromagnetic coils are commonly produced utilizing fine gauge magnet wires, such as magnet wires having gauges ranging from about 30 to about 38 American Wire Gauge ("AWG"). While the electromagnetic coil assembly can easily be designed such that the opposing ends of a given magnet wire project through the dielectric body to provide electrical connection to the potted coil, in instances wherein the dielectric body is relatively rigid, the magnet wire may be subject to unavoidable mechanical stresses concentrated at the wire's entry point into or exit point from the dielectric as the wire is manipulated during manufacture. In view of its relatively fine gauge, the magnet wire is generally unable to withstand significant mechanical stress without fatiguing, work hardening, and potentially snapping or otherwise breaking. Work hardening and mechanical fatigue is especially problematic when the fine gauge magnet wire is fabricated from a metal, such as aluminum, prone to such issues. For this and other reasons, the below-described electromagnetic coil assemblies employ braided lead wires, which terminate within the dielectric body and provide a convenient means of electrical connection to the coiled magnet wire or wires embedded therein. As will be described in more detail below, each braided lead wire assumes the form of a plurality of interwoven filaments or single-strand conductors, which are interwoven into an elongated ribbon, tube, or the like having an extremely high flexibility and mechanical strength. As a result, and in contrast to the fine gauge single strand magnet wire, the braided lead wires are able to withstand significant and repeated mechanical stress without experiencing mechanical fatigue and work hardening. Furthermore, as each braided lead wire is comprised of numerous interwoven filaments, the braided lead wires provide added redundancy in the electrical connection to the potted coil or coils thereby improving the overall durability and reliability of the electromagnetic coil assembly.

Figure 1:
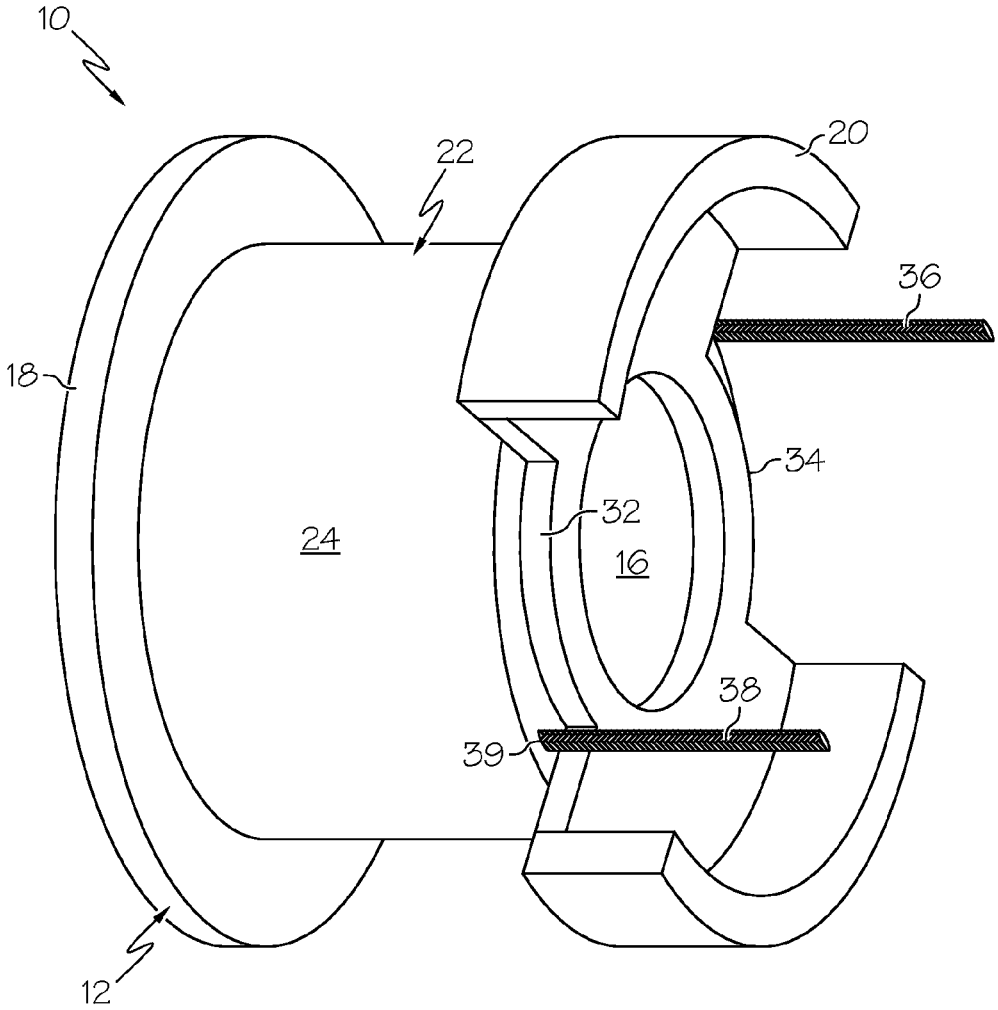
FIGS. 1 and 2 are isometric and cross-sectional views, respectively, of an electromagnetic coil assembly including a plurality of braided lead wires (partially shown) illustrated in accordance with an exemplary embodiment of the present invention.
Figure 2:
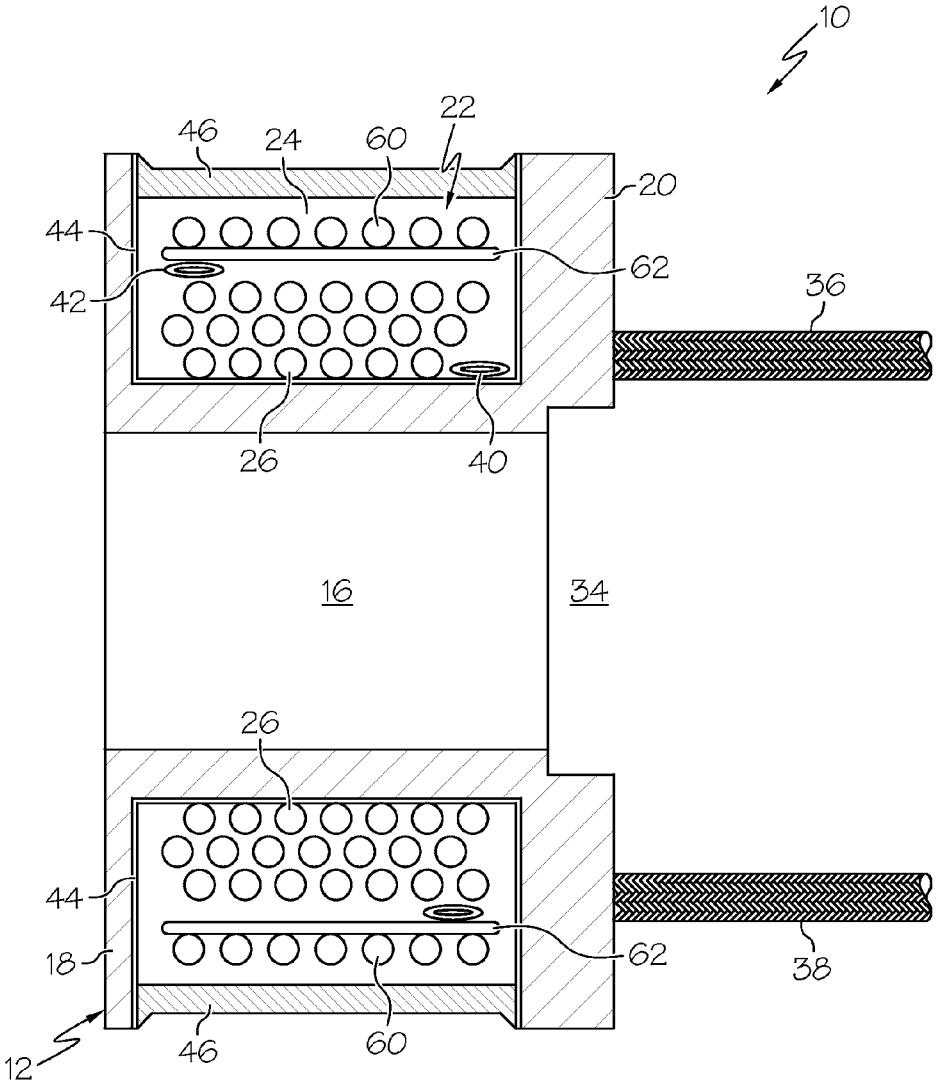

FIGS. 1 and 2 are isometric and cross-sectional views, respectively, of an electromagnetic coil assembly 10 illustrated in accordance with an exemplary embodiment of the present invention. Electromagnetic coil assembly 10 includes a support structure around which at least one magnet wire is wound to produce one or more electromagnetic coils. In the illustrated example, the support structure assumes the form of a hollow spool or bobbin 12 having an elongated tubular body 14 (identified in FIG. 2), a central channel 16 extending through tubular body 14, and first and second flanges 18 and 20 extending radially from opposing ends of body 14. As shown most clearly in FIG. 2, a magnet wire 26 is wound around tubular body 14 to form a multi-layer, multi-turn electromagnet coil, which is embedded within a body of dielectric material 24 (referred to herein as "dielectric body 24"). In addition to providing electrical insulation between neighboring turns of coiled magnet wire 26 through the operative temperature range of the electromagnetic coil assembly 10, dielectric body 24 also serves as a bonding agent providing mechanical isolation and position holding of coiled magnet wire 26 and the lead wire segments extending into dielectric body 24 (described below). By immobilizing the embedded coil (or coils) and the embedded lead wire segments, dielectric body 26 prevents wire chaffing and abrasion when electromagnetic coil assembly is utilized within a high vibratory environment. Collectively, coiled magnet wire 26 and dielectric body 24 form a potted electromagnetic coil 22.

Bobbin 12 is preferably fabricated from a non-ferromagnetic material, such as aluminum, a non-ferromagnetic 300 series stainless steel, or a ceramic. In embodiments wherein bobbin 12 is fabricated form an electrically-conductive material, an insulative coating or shell 44 (shown in FIG. 2) may be formed over the outer surface of bobbin 12. For example, in embodiments wherein bobbin 12 is fabricated from a stainless steel, bobbin 12 may be coated with an outer dielectric material utilizing, for example, a brushing, dipping, drawing, or spraying process; e.g., a glass may be brushed onto bobbin 12 as a paste or paint, dried, and then fired to form an electrically-insulative coating over selected areas of bobbin 12. As a second example, in embodiments wherein electromagnetic coil assembly 10 is disposed within an airtight or at least a liquid-tight package, such as a hermetic canister of the type described below in conjunction with FIGS. 6 and 7, an electrically-insulative inorganic cement of the type described below may be applied over the outer surfaces of bobbin 12 and cured to produce the electrically-insulative coating providing a breakdown voltage standoff between bobbin 12 and coiled magnet wire 26. As a still further possibility, in embodiments wherein bobbin 12 is fabricated from aluminum, bobbin 12 may be anodized to form an insulative alumina shell over the bobbin's outer surface.

As previously indicated, coiled magnet wire 26 may be formed from a magnet wire having a relatively fine gauge; e.g., a gauge of 30 to 38 AWG, inclusive. However, embodiments of the present invention are also advantageously utilized when the coiled magnet wire is of a larger wire gauge (e.g., 24 to 28 AWG) and could chip or otherwise damage the surrounding dielectric material during manipulation if allowed to pass from the interior to the exterior of dielectric body 24. Thus, in preferred embodiments, the gauge of coiled magnet wire 26 may range from about 24 to about 38 AWG. Coiled magnet wire 26 may be fabricated from any suitable metal or metals including, but not limited to, copper, aluminum, nickel, and silver. Coiled magnet wire 26 may or may not be plated. When electromagnet coil assembly 10 is designed for usage within a high temperature environment, coiled magnet wire 26 is preferably fabricated from aluminum, silver, nickel, or clad-copper (e.g., nickel-clad copper). Advantageously, both aluminum and silver wire provide excellent conductivity enabling the dimensions and overall weight of assembly 10 to be reduced, which is especially desirable in the context of avionic applications. Relative to silver wire, aluminum wire is less costly and can be anodized to provide additional electrical insulation between neighboring turns of coiled magnet wire 26 and bobbin 12 and thereby reduce the likelihood of shorting and breakdown voltage during operation of assembly 10. By comparison, silver wire is more costly than aluminum wire, but is also more conductive, has a higher mechanical strength, and is less prone to work hardening.

In low temperature applications, dielectric body 24 may be formed from an organic material, such as a hard plastic. In high temperature applications, however, dielectric body 24 is fabricated from inorganic materials and will typically be substantially devoid of organic matter. In such cases, dielectric body 24 is preferably formed from a ceramic medium or material; i.e., an inorganic and non-metallic material, whether crystalline or amorphous. Furthermore, in embodiments wherein coiled magnet wire 26 is produced utilizing anodized aluminum wire, dielectric body 24 is preferably formed from a material having a coefficient of thermal expansion ("CTE") approaching that of aluminum (approximately 23 parts per million per degree Celsius), but preferably not exceeding the CTE of aluminum, to minimize the mechanical stress applied to the anodized aluminum wire during thermal cycling. Thus, in embodiments wherein coiled magnet wire 26 is produced from anodized aluminum wire, dielectric body 24 is preferably formed to have a CTE exceeding approximately 10 parts per million per degree Celsius ("ppm per ° C.") and, more preferably, a CTE between approximately 16 and approximately 23 ppm per ° C. Suitable materials include inorganic cements, and certain low melt glasses (i.e., glasses or glass mixtures having a melting point less than the melting point of anodized aluminum wire), such as leaded borosilicate glasses. As a still more specific example, dielectric body 24 may be produced from a water-activated, silicate-based cement, such as the sealing cement bearing Product No. 33S and commercially available from the SAUEREISEN® Cements Company, Inc., headquartered in Pittsburgh, Pa.

Dielectric body 24 can be formed in a variety of different manners. In preferred embodiments, dielectric body 24 is formed utilizing a wet-winding process. During wet-winding, the magnet wire is wound around bobbin 12 while a dielectric material is applied over the wire's outer surface in a wet or flowable state to form a viscous coating thereon. The phrase "wet-state," as appearing herein, denotes a ceramic or other inorganic material carried by (e.g., dissolved within) or containing a sufficient quantity of liquid to be applied over the magnet wire in real-time during a wet winding process by brushing, spraying, or similar technique. For example, in the wet-state, the ceramic material may assume the form of a pre-cure (e.g., water-activated) cement or a plurality of ceramic (e.g., low melt glass) particles dissolved in a solvent, such as a high molecular weight alcohol, to form a slurry or paste. The selected dielectric material may be continually applied over the full width of the magnet wire to the entry point of the coil such that the puddle of liquid is formed through which the existing wire coils continually pass. The magnet wire may be slowly turned during application of the dielectric material by, for example, a rotating apparatus or wire winding machine, and a relatively thick layer of the dielectric material may be continually brushed onto the wire's surface to ensure that a sufficient quantity of the material is present to fill the space between neighboring turns and multiple layers of coiled magnet wire 26. In large scale production, application of the selected dielectric material to the magnet wire may be performed utilizing a pad, brush, or automated dispenser, which dispenses a controlled amount of the dielectric material over the wire during winding.

As noted above, dielectric body 24 can be fabricated from a mixture of at least a low melt glass and a particulate filler material. Low melt glasses having coefficients of thermal expansion exceeding approximately 10 ppm per ° C. include, but are not limited to, leaded borosilicates glasses. Commercially available leaded borosilicate glasses include 5635, 5642, and 5650 series glasses having processing temperatures ranging from approximately 350° C. to approximately 550° C. and available from KOARTAN™ Microelectronic Interconnect Materials, Inc., headquartered in Randolph, N.J. The low melt glass is conveniently applied as a paste or slurry, which may be formulated from ground particles of the low melt glass, the particulate filler material, a solvent, and a binder. In a preferred embodiment, the solvent is a high molecular weight alcohol resistant to evaporation at room temperature, such as alpha-terpineol or TEXINOL®; and the binder is ethyl cellulose, an acrylic, or similar material. It is desirable to include a particulate filler material in the embodiments wherein the electrically-insulative, inorganic material comprises a low melt glass to prevent relevant movement and physical contact between neighboring coils of the anodized aluminum wire during coiling and firing processes. Although the filler material may comprise any particulate material suitable for this purpose (e.g., zirconium or aluminum powder), binder materials having particles generally characterized by thin, sheet-like shapes (commonly referred to as "platelets" or "laminae") have been found to better maintain relative positioning between neighboring coils as such particles are less likely to dislodge from between two adjacent turns or layers of the wire's cured outer surface than are spherical particles. Examples of suitable binder materials having thin, sheet-like particles include mica and vermiculite. As indicated above, the low melt glass may be applied to the magnet wire by brushing immediately prior to the location at which the wire is coiled around the support structure.

After performance of the above-described wet-winding process, the green state dielectric material is cured to transform dielectric body 24 into a solid state. As appearing herein, the term "curing" denotes exposing the wet-state, dielectric material to process conditions (e.g., temperatures) sufficient to transform the material into a solid dielectric medium or body, whether by chemical reaction or by melting of particles. The term "curing" is thus defined to include firing of, for example, low melt glasses. In most cases, curing of the chosen dielectric material will involve thermal cycling over a relatively wide temperature range, which will typically entail exposure to elevated temperatures well exceeding room temperatures (e.g., about 20-25° C.), but less than the melting point of the magnet wire (e.g., in the case of anodized aluminum wire, approximately 660° C.). However, in embodiments wherein the chosen dielectric material is an inorganic cement curable at or near room temperature, curing may be performed, at least in part, at correspondingly low temperatures. For example, if the chosen dielectric material is an inorganic cement, partial curing may be performed at a first temperature slightly above room temperature (e.g., at approximately 82° C.) to drive out moisture before further curing is performed at higher temperatures exceeding the boiling point of water. In preferred embodiments, curing is performed at temperatures up to the expected operating temperatures of electromagnetic coil assembly 10, which may approach or exceed approximately 315° C. In embodiments wherein coiled magnet wire 26 is produced utilizing anodized aluminum wire, it is also preferred that the curing temperature exceeds the annealing temperature of aluminum (e.g., approximately 340° C. to 415° C., depending upon wire composition) to relieve any mechanical stress within the aluminum wire created during the coiling and crimping process described below. High temperature curing may also form aluminum oxide over any exposed areas of the anodized aluminum wire created by abrasion during winding to further reduces the likelihood of shorting.

In embodiments wherein dielectric body 24 is formed from a material susceptible to water intake, such as a porous inorganic cement, it is desirable to prevent the ingress of water into body 24. As will be described more fully below, electromagnetic coil assembly 10 may further include a container, such as a generally cylindrical canister, in which bobbin 12, dielectric body 24, and coiled magnet wire 26 are hermetically sealed. In such cases, the ingress of moisture into the hermetically-sealed container and the subsequent wicking of moisture into dielectric body 24 is unlikely. However, if additional moisture protection is desired, a liquid sealant may be applied over an outer surface of dielectric body 24 to encapsulate body 24, as indicated in FIG. 1 at 46. Sealants suitable for this purpose include, but are limited to, waterglass, silicone-based sealants (e.g., ceramic silicone), low melting (e.g., lead borosilicate) glass materials of the type described above. A sol-gel process can be utilized to deposit ceramic materials in particulate form over the outer surface of dielectric body 24, which may be subsequently heated, allowed to cool, and solidify to form a dense water-impenetrable coating over dielectric body 24.

To provide electrical connection to the electromagnetic coil embedded within dielectric inorganic body 24, braided lead wires are joined to opposing ends of coiled magnet wire 26. In the exemplary embodiment illustrated in FIGS. 1 and 2, specifically, first and second braided lead wires 36 and 38 are joined to opposing ends of coiled magnet wire 26. Braided lead wires 36 and 38 extend into or emerge from dielectric body 24 at side entry/exit points 39 (one of which is labeled in FIG. 1). Braided lead wires 36 and 38 each assume the form of a plurality of filaments (e.g., 24 fine gauge filaments) interwoven into a flat ribbon, an elongated tube (shown in FIGS. 1 and 2), or a similar woven structure. Braided lead wires 36 and 38 can be fabricated from a wide variety of metals and alloys, including copper, aluminum, nickel, stainless steel, and silver. Depending upon the particular metal or alloy from which braided lead wires 36 and 38 are formed, the lead wires may also be plated or clad with various metals or alloys to increase electrical conductivity, to enhance crimping properties, to improve oxidation resistance, and/or to facilitate soldering or brazing. Suitable plating materials include, but are not limited to, nickel, aluminum, gold, palladium, platinum, and silver. As shown most clearly in FIG. 1, first and second axial slots 32 and 34 may be formed through radial flange 20 of bobbin 12 to provide a convenient path for routing braided lead wires 36 and 38 to the exterior of potted electromagnetic coil 22.

Braided lead wire 36 is mechanically and electrically joined to a first segment or end of coiled magnet wire 26 by way of a first joint 40 (FIG. 2). Similarly, a second braided lead wire 38 is mechanically and electrically joined to a second segment or opposing end of coiled magnet wire 26 by way of a second joint 42 (FIG. 2). As will be described more fully below, joints 40 and 42 may be formed by any suitable combination of soldering, crimping, twisting, or the like. Notably, joints 40 and 42 are embedded or buried within dielectric body 24. Joints 40 and 42, and therefore the opposing end segments of coiled magnet wire 26, are thus mechanically isolated from bending and pulling forces exerted on the external segments of braided lead wires 36 and 38. Consequently, in embodiments wherein coiled magnet wire 26 is produced utilizing a fine gauge wire and/or a metal (e.g., anodized aluminum) prone to mechanical fatigue and work hardening, the application of strain and stress to coiled magnet wire 26 is consequently minimized and the development of high resistance hot spots within wire 26 is avoided. By comparison, due to their interwoven structure, braided lead wires 36 and 38 are highly flexible and can be repeatedly subjected to significant bending, pulling, twisting, and other manipulation forces without appreciable mechanical fatigue or work hardening. Additionally, as braided lead wires 36 and 38 each contain a plurality of filaments, lead wires 36 and 38 provide redundancy and thus improve the overall reliability of electromagnetic coil assembly 10. If desired, an electrically-insulative (e.g., fiberglass or ceramic) cloth 62 can be wrapped around the outer circumference of coiled magnet wire 26 to further electrically insulate the electromagnetic coil and/to mechanically reinforce joints 40 and 42. Depending upon coil assembly design and purpose, and as generically represented in FIG. 2 by a single layer of wound wire 60, one or more additional coils may further be wound around the central coil utilizing similar fabrication processes.

Figure 3:
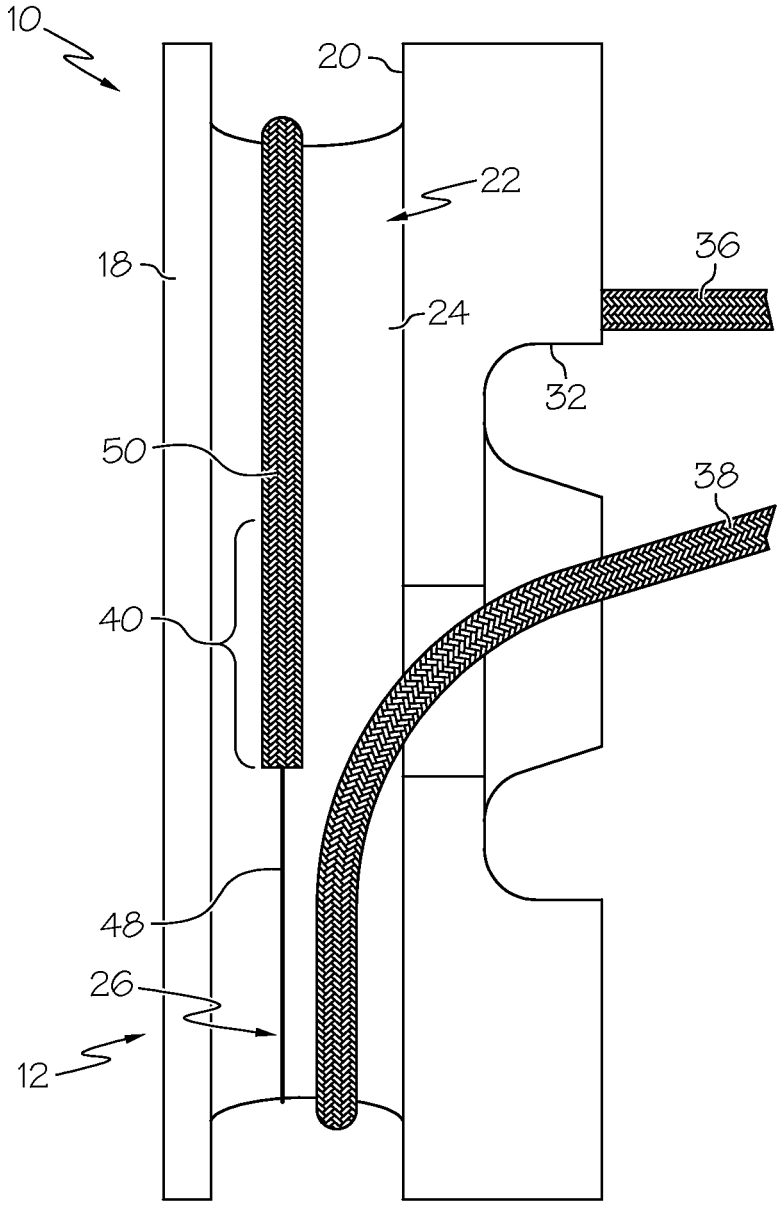
FIG. 3 is a side view of electromagnetic coil assembly shown in FIGS. 1 and 2 during an intermediate stage of manufacture and illustrating one manner in which a braided lead wire can be joined to an end segment of the coiled magnet wire.
Figure 4:
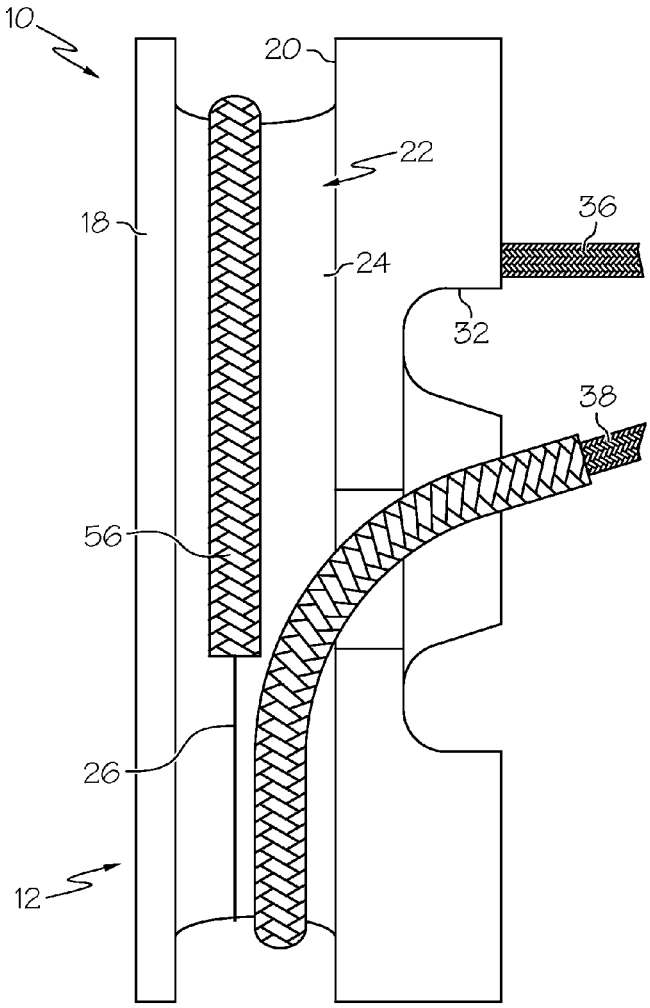
FIG. 4 is a side view of the partially-fabricated electromagnetic coil assembly shown in FIG. 3 and illustrating a flexible, electrically-insulative sleeve that may be disposed over the end segment of braided lead wire joined to the coiled magnet wire and wrapped around the electromagnetic coil.

To facilitate connection to a given braided lead wire, the coiled magnet wire is preferably inserted or threaded into the braided lead wire prior to formation of the wire-to-wire joint. In embodiments wherein the braided lead wire is a flat woven ribbon (commonly referred to as a "flat braid"), the fine gauge magnet wire may be inserted through the sidewall of the interwoven filaments and, perhaps, woven into the braided lead wire by repeatedly threading the magnet wire through the lead wire's filaments in an undulating-type pattern. Alternatively, in embodiments wherein the braided lead is an interwoven tube (commonly referred to as a "hollow braid"), an end portion of the coiled magnet wire may be inserted into the central opening of the tube or woven into the braided lead wire in the previously-described manner. For example, as shown in FIG. 3, which is a side view of electromagnetic coil assembly 10 in a partially-fabricated state, an end portion 48 of coiled magnet wire 26 may be inserted into an end portion 50 of braided lead wire 36 forming joint 40. End portion 50 of braided lead wire 38 is preferably wrapped around the circumference of the electromagnetic coil and ultimately exits the assembly through slot 32 to provide a gradual transition minimizing the application of mechanical stress to end portion 48 of coiled magnet wire 26. If desired, the portion 50 of braided lead wire 38 wrapped around the circumference of the electromagnetic coil assembly may be flattened to reduce the formation of any bulges within the finished electromagnetic coil. To provide additional electrical insulation, a flexible, electrically-insulative sleeve 56 (e.g., a woven fiberglass tube) may be inserted over the portion 50 of braided lead wire 38 wrapped around the circumference of the electromagnetic coil assembly, as further shown in FIG. 4.

Figure 5:
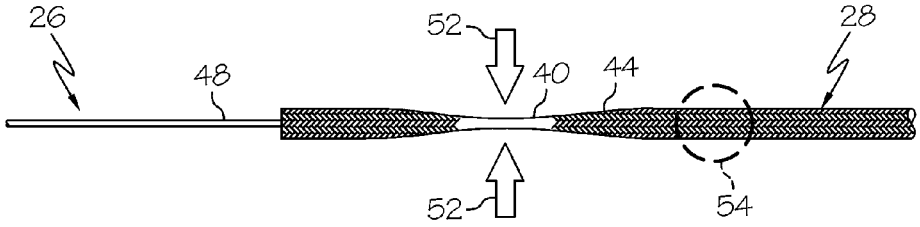
FIG. 5 is a side view of an exemplary crimp and/or solder joint that may be formed between an end segment of the coiled magnet wire and an end segment of the braided lead wire shown in FIG. 3.

As noted above, joints 40 and 42 may be formed by any suitable combination of soldering (e.g., brazing), crimping, twisting, or the like. In preferred embodiments, joints 40 and 42 are formed by soldering and/or crimping. For example, and as indicated in FIG. 5 by arrows 52, end portion 50 of hollow braided lead wire 36 may be crimped over end portion 48 of coiled magnet wire 26. In forming crimp joint 40, a deforming force is applied to opposing sides of end portion 50 of braided lead wire 38 into which end portion 48 of coiled magnet wire 26 has previously been inserted. In this manner, end portion 50 of braided hollow lead wire 38 serves as a crimp barrel, which is deformed over and around end portion 48 of coiled magnet wire 26. The crimping process induces sufficient deformation through crimp joint 42 to ensure the creation of a metallurgical bond or cold weld between coiled magnet wire 26 and braided lead wire 38 forming a mechanical and electrical joint. Crimping can be performed with a hydraulic press, pneumatic crimpers, or certain hand tools (e.g., hand crimpers and/or a hammer). In embodiments wherein braided lead wires are crimped to opposing ends of the magnet wire, it is preferred that the braided lead wires and the coiled magnet wire are fabricated from materials having similar or identical hardnesses to ensure that the deformation induced by crimping is not overly concentrated in a particular, softer wire; e.g., in preferred embodiments wherein joints 40 and 42 are formed by crimping, coiled magnet wire 26, braided lead wire 36, and braided lead wire 38 may each be fabricated from aluminum. Although not shown in FIGS. 3-5 for clarity, braided lead wire 36 may be joined to the opposing end of coiled magnet wire 26 utilizing a similar crimping process.

In addition to, or as an alternative to, crimping, end portion 50 of braided lead wire 38 may be joined to end portion 48 of coiled magnet wire 26 by soldering. In this case, solder material, preferably along with flux, may be applied to joint 40 and heated to cause the solder material to flow into solder joint 40 to mechanically and electrically join magnet wire 26 and lead wire 38. A braze stop-off material is advantageously impregnated into or otherwise applied to braided lead wire 38 adjacent the location at which braided lead wire 38 is soldered to coiled magnet wire 26 (represented in FIG. 4 by dashed circle 54) to prevent excessive wicking of the solder material away from joint 40. Soldering may be performed by exposing the solder materials to an open flame utilizing, for example, a microtorch. The oven is preferably purged with an inert gas, such as argon, to reduce the formation of oxides on the wire surfaces during heating, which could otherwise degrade the electrical bond formed between coiled magnet wire 26 and braided lead wires 36 and 38.

In certain embodiments, such as when the coiled magnet wire 26 is fabricated from an oxidized aluminum wire, it may be desirable to remove oxides from the outer surface of magnet wire 26 and/or from the outer surface of braided lead wire 38 prior to crimping and/or brazing/soldering. This can be accomplished by polishing the wire or wires utilizing, for example, an abrasive paper or a commercially-available tapered cone abrasive dielectric stripper typically used for fine AWG wire preparation. Alternatively, in the case of oxidized aluminum wire, the wire may be treated with a suitable etchant, such as sodium hydroxide or other caustic chemical, to remove the wire's outer alumina shell at the location of crimping and/or soldering. Advantageously, such a liquid etchant can be easily applied to localized areas of the magnet wire and/or braided lead wire utilizing a cotton swab, a cloth, or the like. When applied to the wire's outer surface, the liquid etchant penetrates the relatively porous oxide shell and etches away the outer annular surface of the underlying aluminum core thereby undercutting the outer alumina shell, which then flakes or falls away to expose the underlying core.

Figure 6:
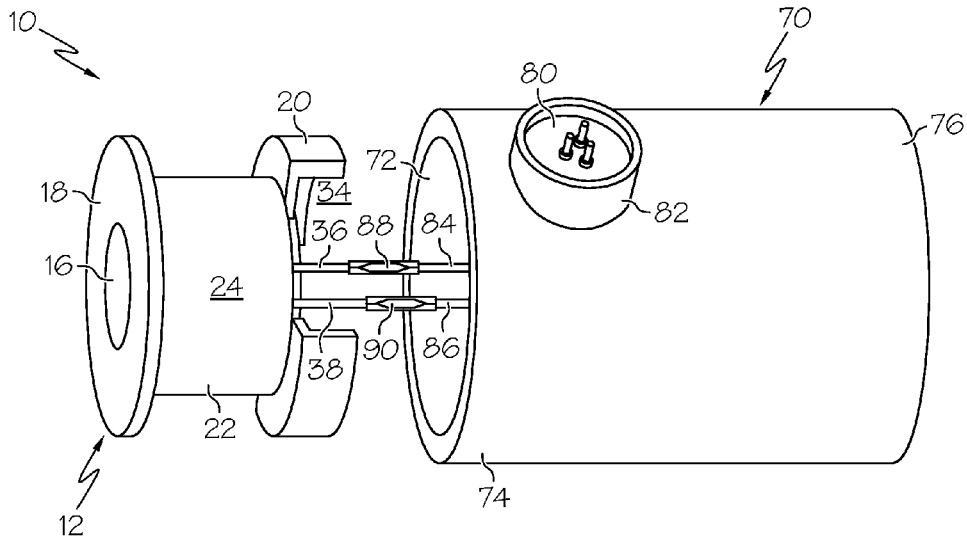
FIGS. 6 and 7 are simplified isometric views illustrating one manner in which the electromagnetic coil assembly shown in FIGS. 1 and 2 may be sealed within a canister in embodiments wherein the coil assembly is utilized within high temperature environments.

After connection of coiled magnet wire 26 to braided lead wires 36 and 38, and after formation of dielectric body 24 (FIG. 1) encapsulating coiled magnet wire 26, potted electromagnetic coil 22 and bobbin 12 may be installed within a canister. Further illustrating this point, FIG. 6 is an isometric view of an exemplary canister 70 having a cavity 72 into which bobbin 12 and the potted coil 22 may be installed. In the exemplary embodiment shown in FIG. 6, canister 70 assumes the form of a generally tubular casing having an open end 74 and an opposing closed end 76. The cavity of canister 70 may be generally conformal with the geometry and dimensions of bobbin 12 such that, when fully inserted into canister 70, the trailing flange of bobbin 12 effectively plugs or covers open end 74 of canister 70, as described below in conjunction with FIG. 7. At least one feedthrough connector 80 is mounted through a wall of canister 70 to enable electrical connection to potted coil 22 while bridging the hermetically-sealed environment within canister 70. For example, as shown in FIG. 6, feedthrough connector 80 may be mounted within a tubular chimney structure 82, which extends through the annular sidewall of canister 70. Feedthrough connector 80 includes one or a plurality of conductive terminal pins, which extend through a glass body, a ceramic body, a mineral-packing (e.g., a magnesium oxide packing), or other insulating hermetic or near hermetic structure. In the illustrated example, feedthrough connector 80 includes three pins; however, the number of pins included within the feedthrough assembly, as well as the particular feedthrough assembly design, will vary in conjunction with the number of required electrical connections and other design parameters of electromagnetic coil assembly 10.

Braided lead wires 36 and 38 may be directly connected to the pins of feedthrough connector 80. However, to facilitate the assembly process, it is preferred that braided lead wires 36 and 38 are each joined to a secondary lead wire, which is, in turn, electrically and mechanically connected to a corresponding pin of feedthrough connector 80. In this regard, and with continued reference to FIG. 6, braided lead wire 36 may be joined to a second braided lead wire 84 utilizing, for example, a crimp barrel 88. Similarly, braided lead wire 38 may be joined to a second braided lead wire 86 utilizing a crimp barrel 90. The opposing ends of braided lead wires 84 and 86 may further be joined to the corresponding pins of connector 80 by, for example, brazing. As can braided lead wires 36 and 38, braided lead wires 84 and 86 can be fabricated from any suitable metal or alloy. In one embodiment, braided lead wires 84 and 86 are fabricated from stainless steel to facilitate brazing to the pins of connector 80, while braided lead wires 36 and 38 and coiled magnet wire 26 are each fabricated from aluminum. In further embodiments, braided lead wires 36 and 38 may be joined to respective braided lead wires 84 and 86 (or similar non-braided lead wires) by soldering or other non-crimping means.

Figure 7:
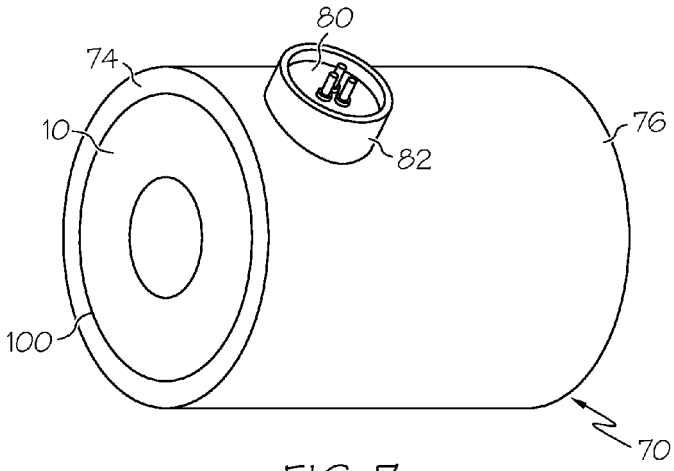

FIG. 7 is an isometric view of electromagnetic coil assembly 10 in a fully assembled state. As can be seen, bobbin 12 and potted coil 22 (identified in FIGS. 1-3 and 5) have been fully inserted into canister 70 such that the trailing flange of bobbin 12 has effectively plugged or covered open end 74 of canister 70. In certain embodiments, the empty space within canister 70 may be filled or potted after insertion of bobbin 12 and potted coil 22 (FIGS. 1-3 and 5) with a suitable potting material. Suitable potting materials include, but are by no means limited to, high temperature silicone sealants (e.g., ceramic silicones), inorganic cements of the type described above, and dry ceramic powders (e.g., alumina or zirconia powders). In the case wherein potted coil 22 is further potted within canister 70 utilizing a powder or other such filler material, vibration may be utilized to complete filling of any voids present in the canister with the powder filler. In certain embodiments, potted coil 22 may be inserted into canister 70, the free space within canister 70 may then be filled with a potting powder or powders, and then a small amount of dilute cement may be added to loosely bind the powder within canister 70. A circumferential weld or seal 100 has been formed along the annular interface defined by the trailing flange of bobbin 12 and open end 74 of canister 70 to hermetically seal canister 70 and thus complete assembly of electromagnetic coil assembly 10. Electromagnetic coil assembly 10 may then be integrated into a coiled-wire device. In the illustrated example wherein electromagnetic coil assembly 10 includes a single wire coil, assembly 10 may be included within a solenoid. In alternative embodiments wherein electromagnetic coil assembly 10 is fabricated to include primary and secondary wire coils, assembly 10 may be integrated into a linear variable differential transducer or other sensor. Due at least in part to the inorganic composition of potted dielectric body 24, electromagnetic coil assembly 10 is well-suited for usage within avionic applications and other high temperature applications. The foregoing example notwithstanding, it is emphasized that various other methods and means can be utilized to hermetically enclose the canister or housing in which the electromagnetic coil assembly is installed; e.g., for example, a separate end plate or cap may be welded over the canister's open end after insertion of the electromagnet coil assembly.

The foregoing has thus provided embodiments of an electromagnetic coil assembly wherein flexible, braided lead wires are joined to a coiled magnet wire partially or wholly embedded within a body of dielectric material to provide a convenient and robust electrical connection between an external circuit and the potted electromagnetic coil, while effectively protecting the magnet wire from mechanical stress during assembly that could otherwise fatigue and work harden the magnet wire. As braided lead wires are fabricated from multiple interwoven filaments, braided lead wires also provide redundancy and thus increase the overall reliability of the electromagnetic coil assembly. The usage of flexible braided lead wires can be advantageous in certain low temperature applications wherein the coiled magnet wire is potted within a relatively rigid, organic dielectric, such as a hard plastic; however, the usage of such flexible braided lead wires is particularly advantageous in high temperature applications wherein highly rigid, inorganic materials are utilized, which are capable of maintaining their electrically-insulative properties at temperatures well-above the thresholds at which conventional, organic dielectrics breakdown and decompose. In such embodiments, the electromagnetic coil assembly is well-suited for usage in high temperature coiled-wire devices, such as those utilized in avionic applications. More specifically, and by way of non-limiting example, embodiments of the high temperature electromagnetic coil assembly are well-suited for usage within actuators (e.g., solenoids and motors) and position sensors (e.g., variable differential transformers and two position sensors) deployed onboard aircraft. This notwithstanding, it will be appreciated that embodiments of the electromagnetic coil assembly can be employed in any coiled-wire device, regardless of the particular form assumed by the coiled-wire device or the particular application in which the coiled-wire device is utilized.

The foregoing has also provided embodiments of a method for manufacturing an electromagnetic coil assembly. In one embodiment, the method includes the steps of winding a magnet wire (e.g., a fine gauge aluminum or silver wire) around a support structure (e.g., a bobbin) to produce an electromagnetic coil; creating a joint (e.g., a solder and/or crimp joint) between the magnet wire and a braided lead wire; and forming a body of dielectric material around the electromagnetic coil in which the joint is at least partially embedded. As noted above, the body of dielectric material is advantageously fabricated from an inorganic material (e.g., a ceramic, inorganic cement, or glass) in high temperature applications; and from an inorganic material or an organic material (e.g., a hard plastic) in low temperature applications.

While multiple exemplary embodiments have been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as set-forth in the appended Claims.

What is claimed is:

1. An electromagnetic coil assembly, comprising:

a body of dielectric material;

a coiled magnet wire at least partially embedded within the body of dielectric material;

a braided lead wire extending into the body of dielectric material to the coiled magnet wire; and a joint buried within the body of dielectric material and mechanically and electrically coupling the braided lead wire and the coiled magnet wire.

2. An electromagnetic coil assembly according to claim 1 wherein an end portion of the coiled magnet wire is inserted into the braided lead wire.

3. An electromagnetic coil assembly according to claim 2 wherein the joint comprises a crimp joint.

4. An electromagnetic coil assembly according to claim 3 wherein the braided lead wire and the coiled magnet wire each comprise aluminum.

5. An electromagnetic coil assembly according to claim 1 wherein the joint comprises a solder material or a braze material mechanically and electrically coupling the coiled magnet wire and the braided lead wire.

6. An electromagnetic coil assembly according to claim 5 wherein the braided lead wire is soldered to the coiled magnet wire, and wherein the electromagnetic coil assembly further comprises a braze stop material impregnated into the braided lead wire adjacent the location at which the braided lead wire is soldered to the coiled magnet wire.

7. An electromagnetic coil assembly according to claim 1 wherein the coiled magnet wire has a wire gauge between 24 and 38 American Wire Gauge, inclusive.

8. An electromagnetic coil assembly according to claim 7 wherein the coiled magnet wire comprises one of the group consisting of aluminum wire, silver wire, nickel wire, or clad-copper wire.

9. An electromagnetic coil assembly according to claim 1 wherein the body of dielectric material comprises an inorganic dielectric material substantially devoid of organic matter.

10. An electromagnetic coil assembly according to claim 9 wherein the body of dielectric material comprises a material selected from the group consisting of an inorganic cement and a glass.

11. An electromagnetic coil assembly according to claim 1 wherein the braided lead wire comprises a plurality of electrically-conductive filaments interwoven into one of the group consisting of a flat ribbon and an elongated tube.

12. An electromagnetic coil assembly according to claim 1 wherein the coiled magnet wire is wound into an electromagnetic coil, and wherein braided lead wire comprises an end segment joined to the coiled magnet wire and wrapped at least partially around the circumference of the electromagnetic coil.

13. An electromagnetic coil assembly according to claim 12 further comprising a flexible, electrically-insulative sleeve disposed over the end segment of the braided lead wire.

14. An electromagnetic coil assembly according to claim 12 wherein the braided lead wire comprises a plurality of electrically-conductive filaments interwoven into an elongated tube having a flattened terminal end segment joined to the coiled magnet wire and wrapped at least partially around the circumference of the electromagnetic coil.

15. An electromagnetic coil assembly according to claim 1 further comprising a second wire coil wound around the coiled magnet wire and over the joint.

16. An electromagnetic coil assembly according to claim 1 further comprising:

a sealed canister in which the coiled magnet wire, the body of dielectric material, and the braided lead wire are disposed; and a multi-pin feedthrough disposed through a wall of the sealed canister and electrically coupled to the coiled magnet wire by way of the braided lead wire.

17. An electromagnetic coil assembly according to claim 16 further comprising a second braided lead wire coupled between the first braided lead wire and a pin of the multi-pin feedthrough.

18. An electromagnetic coil assembly according to claim 17 wherein the first braided lead wire is crimped to the second braided lead wire.

19. An electromagnetic coil assembly, comprising:

a coiled magnet wire;

a rigid body of inorganic dielectric material surrounding the coiled magnet wire;

a braided lead wire having an end portion joined to the coiled magnet wire within the rigid body of inorganic dielectric material, the braided lead wire projecting from the body of dielectric material to provide an electrical connection to the coiled magnet wire; and an electrically-insulative cloth wrapped at least partially around the coiled magnet wire and over the end portion of the braided lead wire joined to the coiled magnet wire.

20. An electromagnetic coil assembly, comprising:

a potted electromagnetic coil, comprising:

a coiled aluminum magnet wire having first and second opposing end portions;

a body of dielectric material surrounding the coiled aluminum magnet wire and composed of at least one inorganic material; and first and second braided lead wires extending into the body of dielectric material and joined to the first and second opposing end portions of the coiled aluminum magnet wire, respectively, to provide electrical connection to the potted electromagnetic coil.

* * * * *